US005512722A

United States Patent [19]

Ozeki et al.

[11] Patent Number: 5,512,722

[45] Date of Patent: Apr. 30, 1996

[54] KEY SWITCH

[75] Inventors: Kumio Ozeki; Fumio Watanabe; Haruo Yoshida; Osam Kamishima; Yosuke Sakai, all of Tokyo, Japan

[73] Assignee: SMK Corporation, Tokyo, Japan

[21] Appl. No.: 160,960

[22] Filed: Dec. 2, 1993

[30] Foreign Application Priority Data

Dec. 2, 1992 [JP] Japan ..... 4-089505

[51] Int. Cl.[6] ..... H01H 13/12

[52] U.S. Cl. ..... 200/517; 200/290

[58] Field of Search ..... 200/517, 513, 200/341, 345, 342, 5 A, 405, 290, 445, 520

[56] References Cited

U.S. PATENT DOCUMENTS

| | | | |
|---|---|---|---|
| 4,733,036 | 3/1982 | Koizumi et al. | 200/517 |
| 4,755,645 | 7/1988 | Naoki et al. | 200/517 X |
| 4,831,223 | 5/1989 | Wako | 200/517 |
| 4,927,990 | 5/1990 | Aoki et al. | 200/517 |
| 4,931,606 | 6/1990 | Bruner | 200/517 |
| 5,120,923 | 6/1992 | Kato et al. | 200/520 |
| 5,145,058 | 9/1992 | Lee | 200/517 |
| 5,201,824 | 4/1993 | Kato et al. | 200/520 |
| 5,306,886 | 4/1994 | Yamada | 200/517 |

FOREIGN PATENT DOCUMENTS

| | | | |
|---|---|---|---|
| 183020 | 7/1989 | Japan | 200/517 |
| 264125 | 10/1989 | Japan | 200/517 |
| 4073829 | 3/1992 | Japan | 200/517 |

*Primary Examiner*—Renee S. Luebke

*Attorney, Agent, or Firm*—Mark Catan; Alfred W. Froebrich; Thomas R. Morrison

[57] ABSTRACT

A membrane switch is actuated by pressure transmitted from a movable key member through two coaxial springs connected end-to-end. A first of the two springs is held by the key member in a partially strained state requiring an initial force to strain it further. The second spring, smaller in diameter and stiffer than the first, has a free end at which force is applied to the membrane switch. As a top of the key member is pressed, the free end of the second spring moves toward, touches, then presses the membrane switch. Force builds rapidly with displacement in the small spring until it reaches the initial force under which the first spring is retained. This initial force is made roughly equal to the force required to actuate the membrane switch. After that point, the force-displacement characteristic is that of the two-spring combination, which is less stiff than the second spring alone. Thus, long key travel is permitted while the actuation force is reached early in the displacement of the key member. In one embodiment, a resilient boot, covering a key stem of the key switch, buckles when the key is pressed to provide a click-like feedback to an operator.

18 Claims, 8 Drawing Sheets

KEY SWITCH

BACKGROUND OF THE INVENTION

This invention relates to a key switch for use in key input devices, for example, point of sale terminals and electronic cash registers.

Referring to FIG. 4, a typical conventional key switch 100 for a key input device includes a single piece housing 10 with a key stem guide sleeve 12. A key stem 14 fits slidably into key stem guide sleeve 12. A key cap support 24 joins a cup-shaped key cap 16 to key stem 14. Depressing key cap 16 causes key stem 14 to slide downward. A tip of a coil spring 18 set inside key stem 14 electrically connects stationary contacts 22, 22 of a flexible printed circuit ("FPC") 21 on a printed wiring board ("PWB") 20.

Conventional key switch 100 is susceptible to dust and water infiltration through a gap between an inner surface of key stem guide sleeve 12 and an outer surface of key stem 14. To eliminate such infiltration, a novel key switch 101, shown in FIG. 5 (see Japanese Utility Model Application No. 74274/'91)has been proposed. In key switch 101 a key cap support 26 connects key cap 16 and key stem 14. Key cap support 26 has a top annular groove 27 in its undersurface. A bottom annular groove 29 encircles the outside of a base of key stem guide sleeve 12. A boot 28, of elastic material such as synthetic rubber, fits between key cap support 26 and housing 10.

Boot 28 has a large-diameter cylindrical end portion **28*b* with a small outward flange 28*a*. Large-diameter cylindrical end portion 28*b* is contiguous with a tapering cylindrical middle portion 28*c*. Tapering cylindrical middle portion 28*c* is contiguous with a small-diameter cylindrical end portion 28*d*. Small outward flange 28*a* is inserted in top annular groove 27. An edge of small-diameter cylindrical end portion 28*d* is inserted in bottom annular groove 29. These insertions constitute a hermetic seal at the ends of boot 28 and thus prevent dust or water from infiltrating coil spring 18 and stationary contacts 22, 22, through a gap between the inner surface of key stem guide sleeve 12 and the outer surface of key stem 14. Boot 28 urges key cap 16** back to a home (upper) position and thus acts as a return spring.

Key cap support 26 consists of a disk **26*a* affixed to key stem 14 by means of, for example, a screw. Disk 26*a* has an integral short cylinder portion 26*b* at its periphery. Disk 26*a* also has an integral outwardly extending flange 26*c* and an integral inwardly extending flange 26*d*. Outwardly extending flange 26*c* is fitted into cup-shaped key cap 16 to support key cap 16 rigidly. Inwardly extending flange 26*d* engages small outward flange 28*a* of boot 28 to secure boot 28** against accidental detachment.

When stationary contacts 22, 22 of FIG. 5 are replaced with a membrane switch (not shown), then coil spring 18 serves to press, and thereby actuate, the membrane switch as key cap 16 is pressed downward. When key switch 101 is pressed, coil spring 18 is brought closer to the membrane switch until it touches it. As key switch 101 is further pressed, coil spring 18 is compressed. A relatively large distance must be traversed before a large enough restoring force builds in coil spring 18 to overcome the resistance of the membrane switch, thereby causing the membrane switch to close. This is a significant drawback of the prior art design as explained below with reference to FIG. 6.

FIG. 6 illustrates a force-displacement curve that is characteristic of key switch 101 of FIG. 5. The upper home position of key stem 14 is indicated by 0 on the horizontal axis. From point 0 through point $S_p$ to point $S_b$, the restoring force depends entirely on the elastic deformation of boot 28. When the stroke distance exceeds point Sb, the force-displacement curve $M_a$ of coil spring 18 is superimposed on that of boot 28. $Q_a$ represents the point at which the membrane switch is actuated. $F_a$ represents the force required to actuate the membrane switch. $S_n$ represents the travel of key cap 16 from the point at which coil spring 18 makes contact with the membrane switch and the point of actuation. In other words, before the force corresponding to $Q_a$ is reached, a displacement equal to $S_n$ must be traversed. When the restoring force reaches the peak point P, boot 28 buckles, rapidly reducing the restoring force generated by boot 28. The restoring force falls up to point B, imparting a click-like feel to key cap 16. Further depressing key cap 16 compresses coil spring 18. The dashed line $M_a$ represents the restoring three versus displacement curve characteristic of coil spring 18 alone. The restoring force of coil spring 18 is applied to the membrane switch as coil spring 18 is compressed by displacement past point $S_b$. The membrane switch is activated by a three of $F_a$. The total restoring force from point B to point $Q_a$ is equal to the sum of the restoring forces of boot 28, line $K_a$, and coil spring 18, line $M_a$. The total restoring force reaches $Q_a$ at the displacement, $S_b+S_n$ where the force $F_a$ is applied to the membrane switch.

The problem with the designs of key switches 100 and 101 of FIGS. 4 and 5 is that a shallow stroke of the key switch may fail to actuate the membrane switch. Thus, professional operators typing at high speed may tend to stroke such key switches without actuating the switch, causing errors in data input. This is a serious problem inherent in the prior art key switch structure.

OBJECTS AND SUMMARY OF THE INVENTION

An object of the present invention is to provide a key switch that overcomes the drawbacks of the prior art.

Another object of the present invention is to provide a key switch which easily actuates an incorporated membrane switch.

Still another object of the present invention is to provide a key switch which reliably actuates an incorporated membrane switch.

Still another object of the present invention is to provide a key switch for operating an incorporated membrane switch which requires less key travel before the membrane switch is actuated.

Still another object of the present invention is to provide a key switch that has superior tactile response.

Briefly stated, there is disclosed a key switch wherein a membrane switch is actuated by pressure transmitted from a movable key member through two coaxial springs connected end-to-end. A first of the two springs is held by the key member under compression so that an initial force must be applied to it to compress it further. The second spring, smaller in diameter and stiffer than the first, has a free end at which force is applied to the membrane switch. As a top of the key member is pressed, the free end of the second spring moves toward, touches, then presses the membrane switch. Force builds rapidly with displacement in the small spring until it reaches the initial force under which the first spring is retained. This initial force is made roughly equal to the force required to actuate the membrane switch. After that point, the force-displacement characteristic is that of the two-spring combination, which is less stiff than the second spring alone. Thus, long key travel is permitted while the actuation force is reached early in the displacement of the key member.

According to an embodiment of the present invention, there is disclosed a key switch, comprising: a housing, a key element, a switch connected to the housing, a first spring operatively associated with the key element, means, connected to the key element, for applying a retaining force to the first spring such that the first spring is maintained in a partially strained state whereby a non-zero initial force must be applied to the first spring to strain it further, a second spring operatively associated with the first spring, the second spring having a free end, means for displacing the free end toward the switch when the key element is displaced and for pressing the free end against the switch when the key element is displaced further whereby the switch is actuated and the second spring being strained by a force of the pressing, the first spring being strained when the force of the pressing exceeds the non-zero initial force.

According to another embodiment of the present invention, there is disclosed a key switch, comprising: a housing, a key stem guide sleeve integral with the housing, a key stem slidably inserted in the key stem guide sleeve, a first spring connected to the key stem guide sleeve, a retainer for applying a retaining force to the first spring such that the first spring is maintained in a partially strained state, whereby a non-zero initial force must be applied to the first spring to strain it further, a second spring, having a free end, a further end of the second spring being connected to an end of the first spring, the free end being displaced toward a switch upon a displacement of the key stem in a positive direction and the free end making contact with and applying a force to the switch upon a further displacement of the key stem in the positive direction, whereby the switch is actuated, the second spring being strained by the force and thereby producing a restoring force which restoring force the second spring transmits to the first spring and the second spring being strained when the restoring force exceeds the non-zero initial force.

According to still another embodiment of the present invention, there is disclosed a key switch, comprising: a housing, a switch, a key, movably mounted to the housing, for actuating the switch, a member having a free end, a resilient member, means for transferring a force applied to the key through the resilient member to the member free end, the free end touching the switch at a point in a displacement of the key, the free end applying a further force to the switch when the key is displaced in a positive direction beyond the point, the further force straining the resilient means, the further force being function of a the displacement, the function having a first generally linear region with a slope substantially higher than a slope of a second generally linear region of the function, the first generally linear region beginning at the point and extending in the positive direction relative to the point and the second generally linear region beginning at an end of the first generally linear region and extending in the positive direction beyond the end.

According to still another embodiment of the present invention, there is disclosed a key switch, comprising: a housing, a switch attached to the housing, a key, movably mounted to the housing, means for applying an actuating force to the switch, the means for applying including a resilient member retained under an initial amount of strain, the actuating force resulting from a pressing force applied to the key, the pressing force being transmitted by the means for applying, through the resilient means, to generate the actuating force, the pressing force straining the resilient beyond the initial amount when the pressing force exceeds a specified value and the specified value being a function of the initial amount of strain.

According to still another embodiment of the present invention, there is disclosed a key switch, comprising: a housing, a key element, a switch connected to the housing, a first spring operatively associated with the key element, means, connected to the key element, for applying a retaining force to the first spring such that the first spring is maintained in a partially strained state whereby a non-zero initial force must be applied to the first spring to strain it further, a second spring operatively associated with the second spring, a pressing member having a free end, the pressing member being operatively associated with the second spring, means for displacing the free end toward the switch when the key element is displaced and for pressing the free end against the switch when the key element is displaced further, the means for displacing including means for transferring a force of the pressing to the second spring thereby straining the second spring, the second spring being strained when the force of the pressing exceeds the a value proportional to the non-zero initial force and the combined restoring force being applied through the tree end, against the switch thereby actuating the switch.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1A:
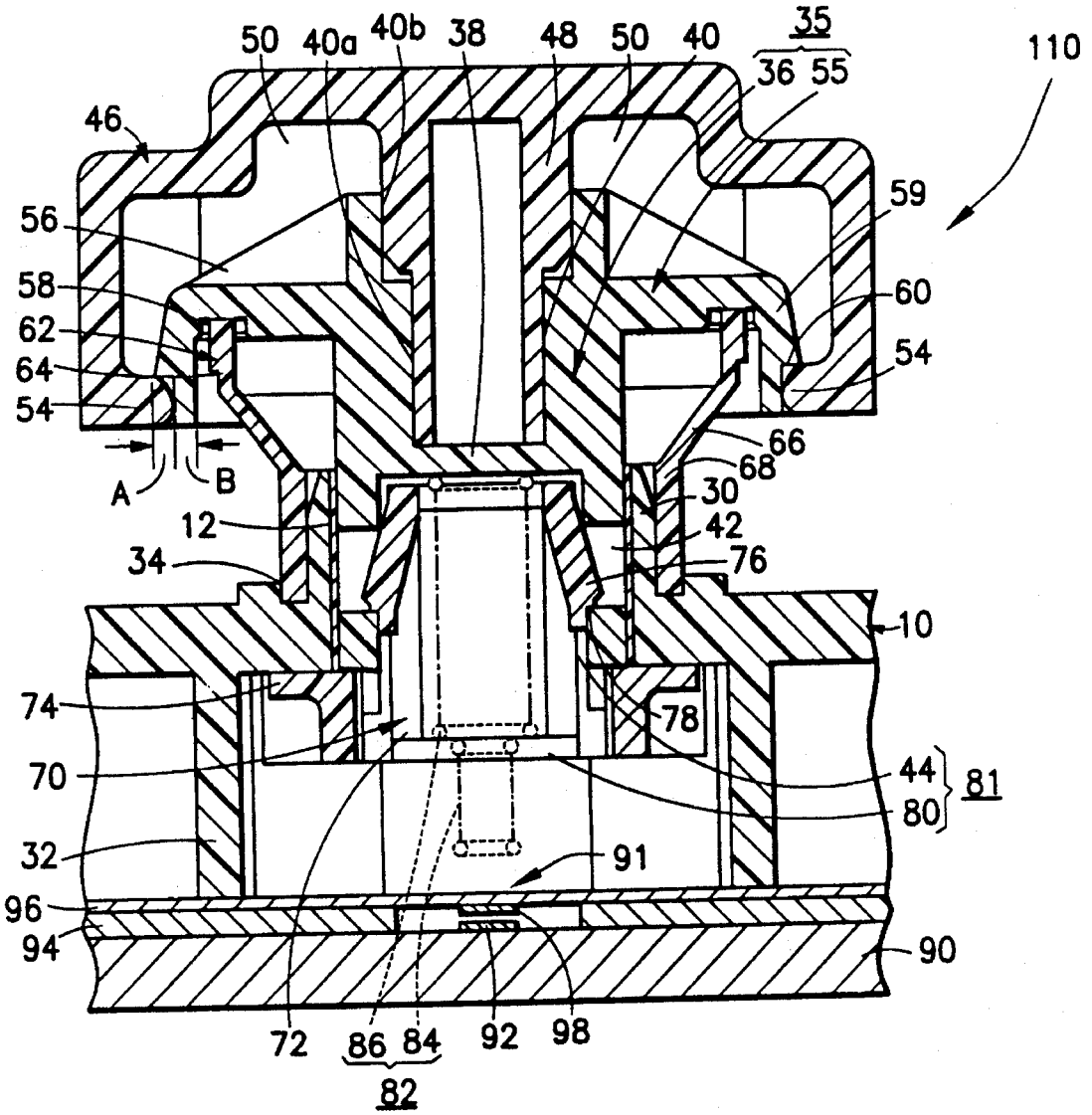
FIG. 1*a* is a front cross section of a key switch according to an embodiment of the present invention.
Figure 1B:
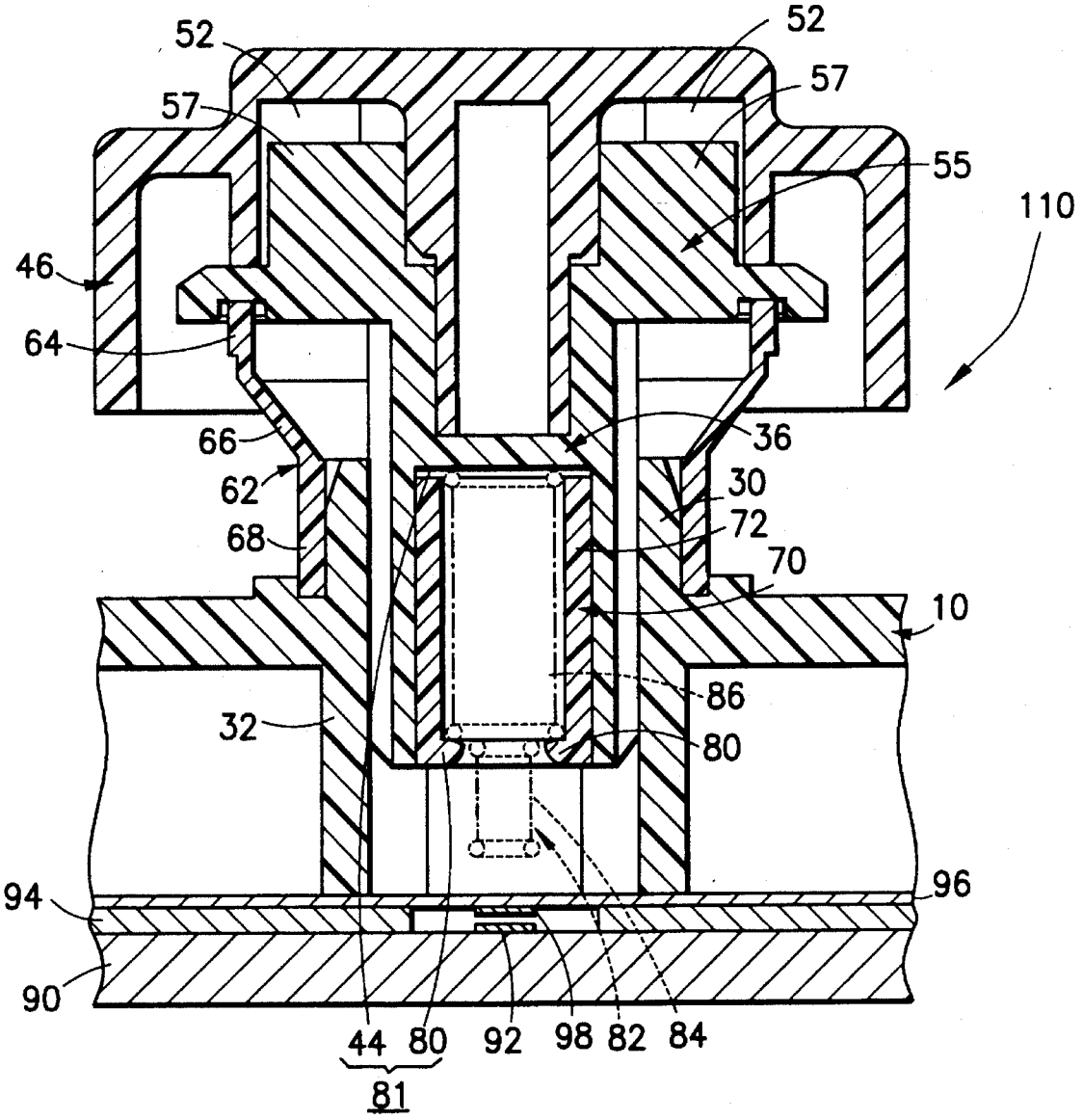
FIG. 1*b* is a side cross section of the key switch of FIG. 1*a*.
Figure 2:
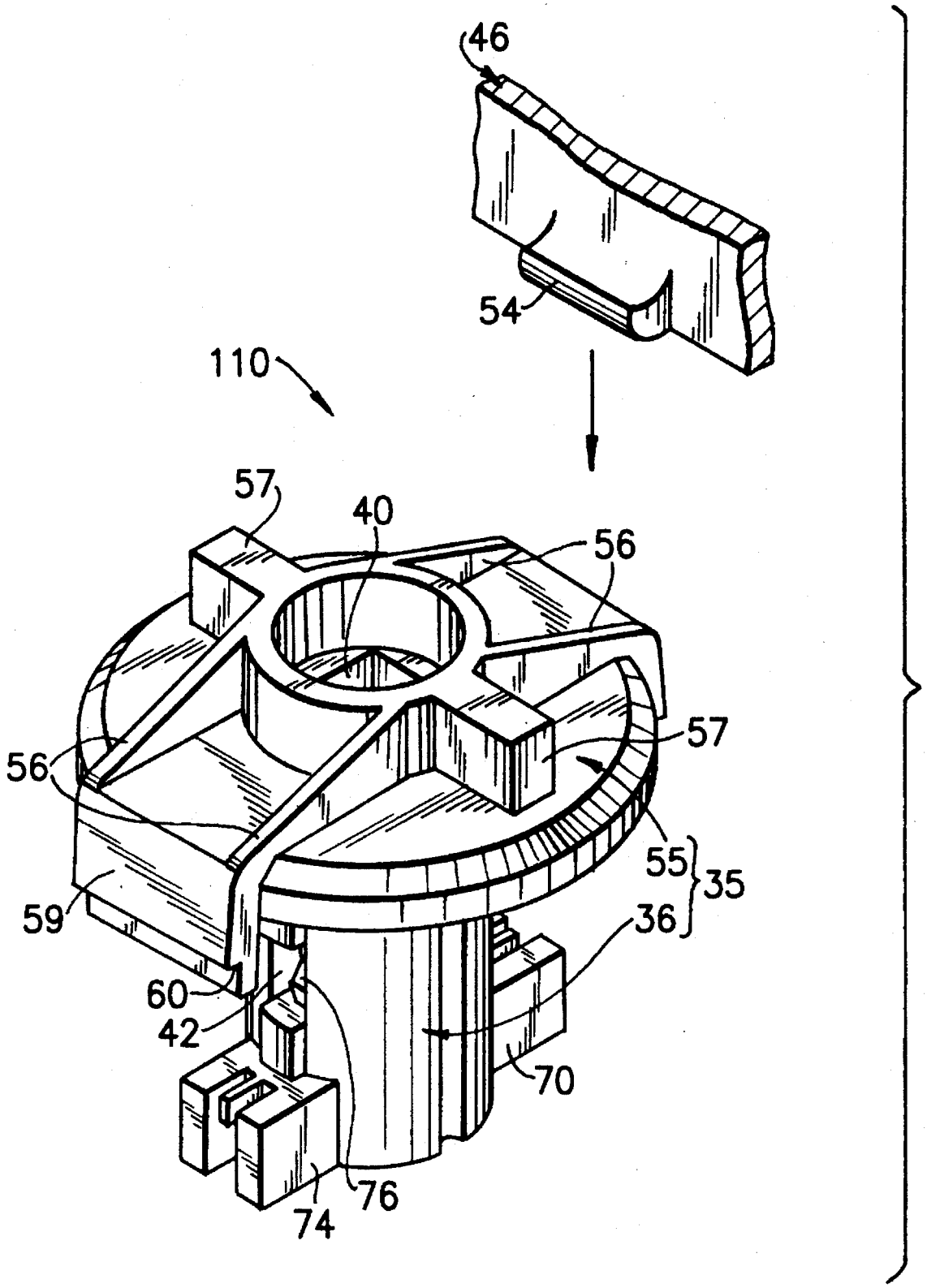
FIG. 2 is a perspective view of a principal part of the key switch of FIGS. 1*a* and 1*b*.

Referring to FIGS. 1*a*, 1*b* and 2, a key switch 110 has a housing 10, of molded synthetic resin, with an integral key stem guide sleeve 12. Key stem guide sleeve 12 consists of an upper guide sleeve 30, which extends above housing 10, and a lower guide sleeve 32, extending down through housing 10. Between upper and lower guide sleeves 30 and 32 is a through-hole. A lower annular groove 34 encircles the outside of upper guide sleeve 30 at its base.

A key stem 35, of molded synthetic resin, includes a sliding member 36, which is roughly cylindrical in shape. Sliding member 36 is slidably inserted in key stem guide sleeve 12. A key cap support 55 which is integral with key stem 35 has a wide integral flange projecting radially from an upper periphery of sliding member 36. A barrier 38 lies at an upper end of an upper cavity in sliding member 36.

Barrier 38 is located near a center of sliding member 36. Barrier 38 partitions an upper cavity 40 and a lower cavity 44. Lower cavity 44 includes windows 42, 42. Upper cavity 40 is composed of a first cavity 40*a* and a second cavity 40*b*. First cavity 40*a* has a square cross section and is contiguous with, and below, second cavity 40*b*. Second cavity 40*b* has a circular cross section of larger area than that of first cavity 40*a*.

A key cap 46, of molded synthetic resin, has an integral shouldered shaft 48 projecting downward from a bottom surface of key cap 46. Shouldered shaft 48 is press-fitted into upper cavity 40 of sliding member 36. Key cap 46 has guiding recesses 50, 50 and 52, 52. A top portion of a key cap support 55 has integral projections 56, 56 and 57, 57. When key cap 46 is assembled to key cap support 55, projections 56, 56 and 57, 57 fit into guiding recesses 50, 50 and 52, 52, respectively. This fit prevents rotation of key cap 46 relative to key cap support 55.

Key cap 46 has a pair of integral engaging jaws 54, 54 projecting inwardly from opposite sides on the periphery of key cap 46. Key cap support 55 has a pair of integral arms 59, 59 opposite each other and projecting downward. When key cap 46 is assembled to key cap support 55, a pair of interlocking steps 60, 60 in outer surfaces of tips of arms 59, 59 engage engaging jaws 54, 54 of key cap 46. A depth A of engagement, between engaging jaws 54, 54 and interlocking steps 60, 60, is related to an extraction force required to remove key cap 46 from key cap support 55. A thickness B of the tip of each arm 59 is controlled to make the depth A equal to a predetermined value. Any shape defect, caused by faulty molding in making key cap 46, can cause variation in depth A of engagement between key cap 46 and sliding member 36. Depth A may be larger than a predetermined value so that the extraction force becomes too large, making the extraction of key cap 46 difficult. Depth A may be lower than the predetermined value so that the extraction force becomes too small, allowing key cap 46 to fall off key cap support 35. To prevent this variation, the quantity B is controlled to keep the quantity A constant so that the extraction force remains constant.

A boot 62, of elastic material such as synthetic rubber, has a large-diameter cylindrical end portion 64. Large-diameter cylindrical end portion 64 is contiguous with a tapering cylindrical middle portion 66. Tapering cylindrical middle portion 66 is contiguous with a small-diameter cylindrical end portion 68. An upper annular groove 58 encircles shouldered shaft 48 on the bottom of key cap support 55. Large-diameter cylindrical end portion 64 is inserted in upper annular groove 58. An edge of small-diameter cylindrical end portion 68 is inserted in lower annular groove 34. At the same time, small-diameter cylindrical end portion 68 is slipped snugly over upper guide sleeve 30. These insertions, and the snug fit, constitute a hermetic seal at the ends of boot 62, preventing dust or water from infiltrating the space surrounded by boot 62.

A stopper 70, of molded synthetic resin, consists of a hollow cylinder 72 slidably inserted in lower cavity 44 of sliding member 36. Key stem stopper 70 has a stopper base 74 which is integral with hollow cylinder 72. Hollow cylinder 72 has a pair of flaps 76, 76 that are cut from the wall thereof. Lower ends of flaps 76, 76 have stepped edges 78, 78 which engage with lower edges of windows 42, 42 in sliding member 36. Stopper base 74 is prevented from rotating by engagement of stopper base 74 with a side wall of lower guide sleeve 32 of housing 10.

A lower end of hollow cylinder 72 has a pair of spring retaining ledges 80, 80 which project into lower cavity 44. Spring retaining ledges 80, 80 and lower cavity 44 constitute a spring holder 81. A coil spring 82 is partly encased within lower cavity 44. Coil spring 82 consists of a small-diameter coil spring 84 and a large-diameter coil spring 86 wound from a single wire. Large-diameter coil spring 86 is retained by spring holder 81 in a partly compressed state. Large-diameter coil spring 86 is retained between an undersurface of barrier 38 and inwardly projecting spring retaining ledges 80, 80. The degree of compression is set to a specified value so that a force equal to the retaining force is required to cause large-diameter coil spring to compress further. Small-diameter coil spring 84 extends downward from the lower end of hollow cylinder 72 without touching spring retaining ledges 80, 80. Therefore no pre-set compression is applied to small-diameter coil spring 84. A free end of small-diameter coil spring 84 lies above, and close to, a membrane switch 91 at the bottom of the cavity defined by lower guide sleeve 32.

Membrane switch 91 includes a stationary contact 92 on a printed wiring board ("PWB") 90 substrate. Stationary contact 92 connects to a printed circuit (not shown). On top of PWB 90 is a spacer 94. On top of spacer 94 is a flexible printed circuit ("FPC") 96. A movable contact 98 is attached to an undersurface of FPC 96. Membrane switch 91 is actuated by pressing FPC 96 downward from directly above movable contact 98. FPC 96 flexes, causing movable contact 98 to approach stationary contact 92. When movable contact 98 touches stationary contact 92, electrical continuity is established and membrane switch 91 is actuated. Key board housing 10 is positioned above FPC 96 so that a lower end of small-diameter coil spring 84 is located directly above stationary contact 92.

To assemble the embodiment described above, the end of small-diameter cylindrical end portion 68 of boot 62 is fitted into lower annular groove 34 formed around upper guide sleeve 30 of housing 10. Sliding member 36 of key stem 35 is inserted from above into key stem guide sleeve 12. An edge of large-diameter cylinder portion 64 of boot 62 is fitted into upper annular groove 58 of key cap support 55. Stopper 70 is assembled to a lower end of sliding member 36 by pushing stopper 70 upward toward key cap support 55 until stepped edges 78, 78 of flaps 76, 76 engage lower edges of windows 42, 42. At the same time, large-diameter coil spring 86 is held under compression in hollow cylinder 72 of stopper 70. The upper end of large-diameter coil spring 86 is urged against barrier 38 while the lower end, connected to small-diameter coil spring 84, is pushed up by ledge projections on spring retaining ledges 80, 80 of stopper 70. Key cap 46 is then pressed down so that projections 56, 56 and 57, 57 can be press-fitted into guiding recesses 50, 50 and 52, 52. At the same time, shouldered shaft 48 of key cap 46 is press-fitted into upper cavity 40 of sliding member 36. Simultaneously, engaging jaws 54, 54 engage interlocking steps 60, 60 to hold key cap 46 onto key cap support 55.

Key switch 110 is operated as follows. When sliding member 36 of key stem 35 is shifted down by pressing key cap 46, coil spring 82 is carried down so that the lower end of small-diameter coil spring 84 is forced against FPC 96. As a result of further downward movement, movable contact 98 touches stationary contact 92, activating membrane switch 91.

Boot 62 is elastically deformed when an operator pushes key cap 46 down. A force is transmitted to key cap support 55. Tapering cylindrical middle portion 66 buckles when the force exceeds a buckling load of tapering cylindrical middle portion 66, so that a click-like feeling is sensed by the operator at key cap 46. When the force upon key cap 46 is released, key cap 46 returns to a home (top) position due to the restoring forces generated by tapering cylindrical middle portion 66 and coil spring 82.

Figure 3A:
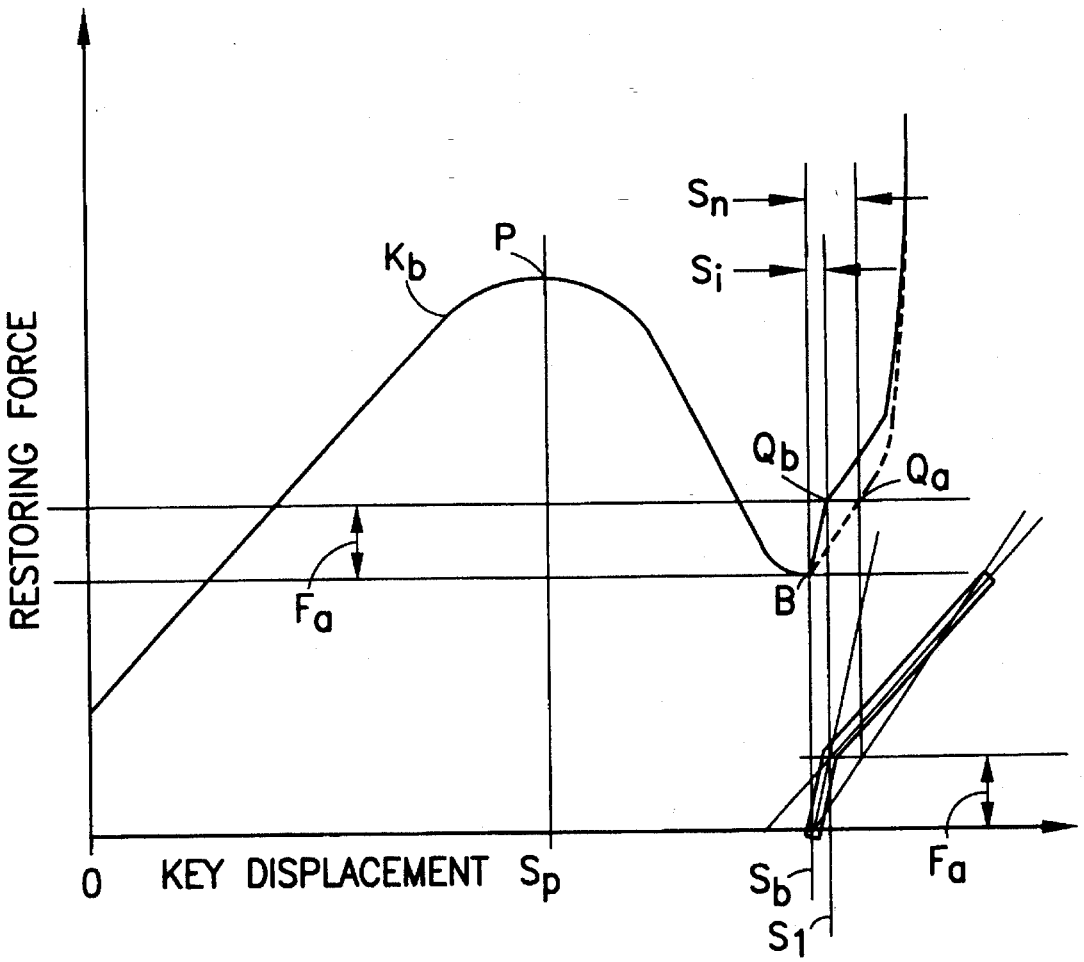
FIG. 3*a* is a restoring force-displacement curve characteristic of the embodiment of FIGS. 1*a* and 1*b*.

The force displacement curve that characterizes the operation of key switch 110 is shown in FIG. 3*a*. From the home position until the key is displaced to point $S_b$, which is the point at which the free end of small-diameter coil spring 84 makes contact with FPC 96, the restoring force, indicated by curve $K_b$, depends mainly on the elastic deformation of boot 62. The restoring force reaches a peak point P, as boot 62 starts to buckle. The restoring force rapidly falls to the force-minimum point B after boot 62 buckles. As a result, a click shock is transmitted to key cap 46. This is similar to the behavior of prior art key switch 101, described above. From the point $S_b$ and beyond, however, the force-displacement curve of key switch 110 and that of prior art key switch 101 are substantially different.

When key cap 46 is pressed, sliding member 36 carries coil spring 82 downward toward membrane switch 91 until the free end of small-diameter coil spring 84 contacts membrane switch 91. Small-diameter coil spring 84 is compressed slightly until the restoring force generated by its compression overcomes the retaining force applied to large-diameter coil spring 86 by spring retaining ledges 80, 80. After that point, both springs are compressed in concert. A smaller spring is stiffer than a similarly constructed larger spring wound from the same wire. Therefore, small-diameter coil spring 84 is compressed very little before its restoring force exceeds the retaining force applied to large-diameter coil spring 86 by spring retaining ledges 80, 80. In terms of the linear model of spring behavior, the spring constant of small-diameter coil spring 84 is greater than that of large-diameter coil spring 86 so that it doesn't have to be compressed as much to generate the same restoring force.

Figure 3B:
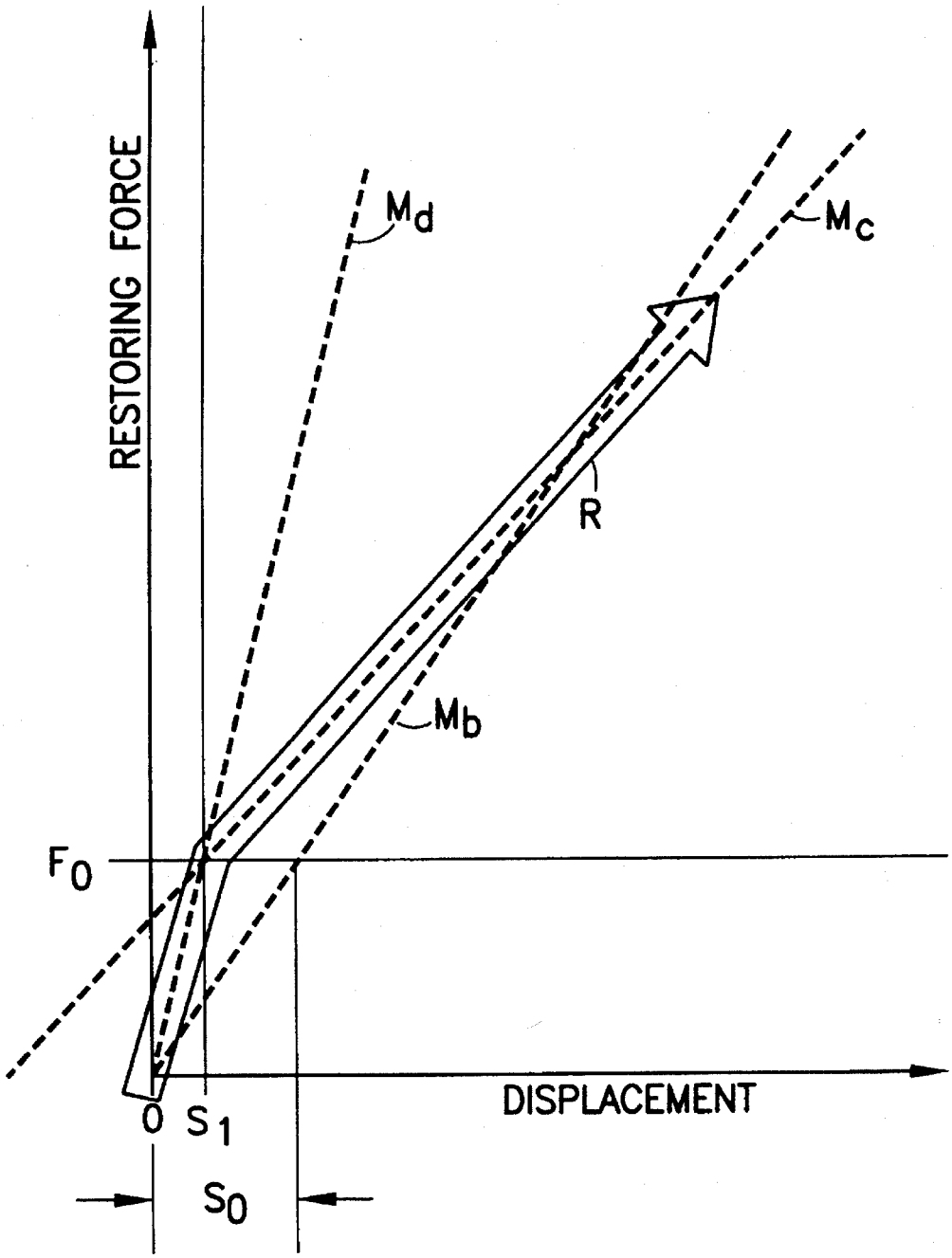
FIG. 3*b* is a restoring force-displacement curve characteristic of spring elements of the embodiment of FIGS. 1*a* and 1*b* according where a small-diameter spring element with a relatively low spring constant is employed.

Referring to FIG. 3*b*, the force displacement curves characteristic of small-diameter coil spring 84 and large-diameter coil spring 86 are shown. Curves $M_d$ and $M_b$ correspond respectively to small-diameter coil spring 84 and large-diameter coil spring 86. $F_0$ is the force required to compress large-diameter coil spring 86 to the initial state of compression imposed by spring retaining ledges 80, 80. $S_0$ is the initial distance that large-diameter coil spring 86 is compressed. The intersection of line $F_0$ with curve $M_d$ thus represents the point at which the restoring force of small-diameter coil spring 84 reaches the retention force imposed on large-diameter coil spring 86. This occurs at displacement point $S_1$. After point $S_1$ both springs are compressed together. The force-displacement curve representing the combination of the two springs is indicated by curve $M_c$. Note that curve $M_c$ has a lower slope than either of curves $M_d$ or $M_b$. The lower slope is characteristic of a spring system consisting of two springs attached end-to-end as in the present invention. The spring constant of two springs attached end-to-end is equal to the product of the spring constants of the two springs divided by the sum of their spring constants.

Figure 3C:
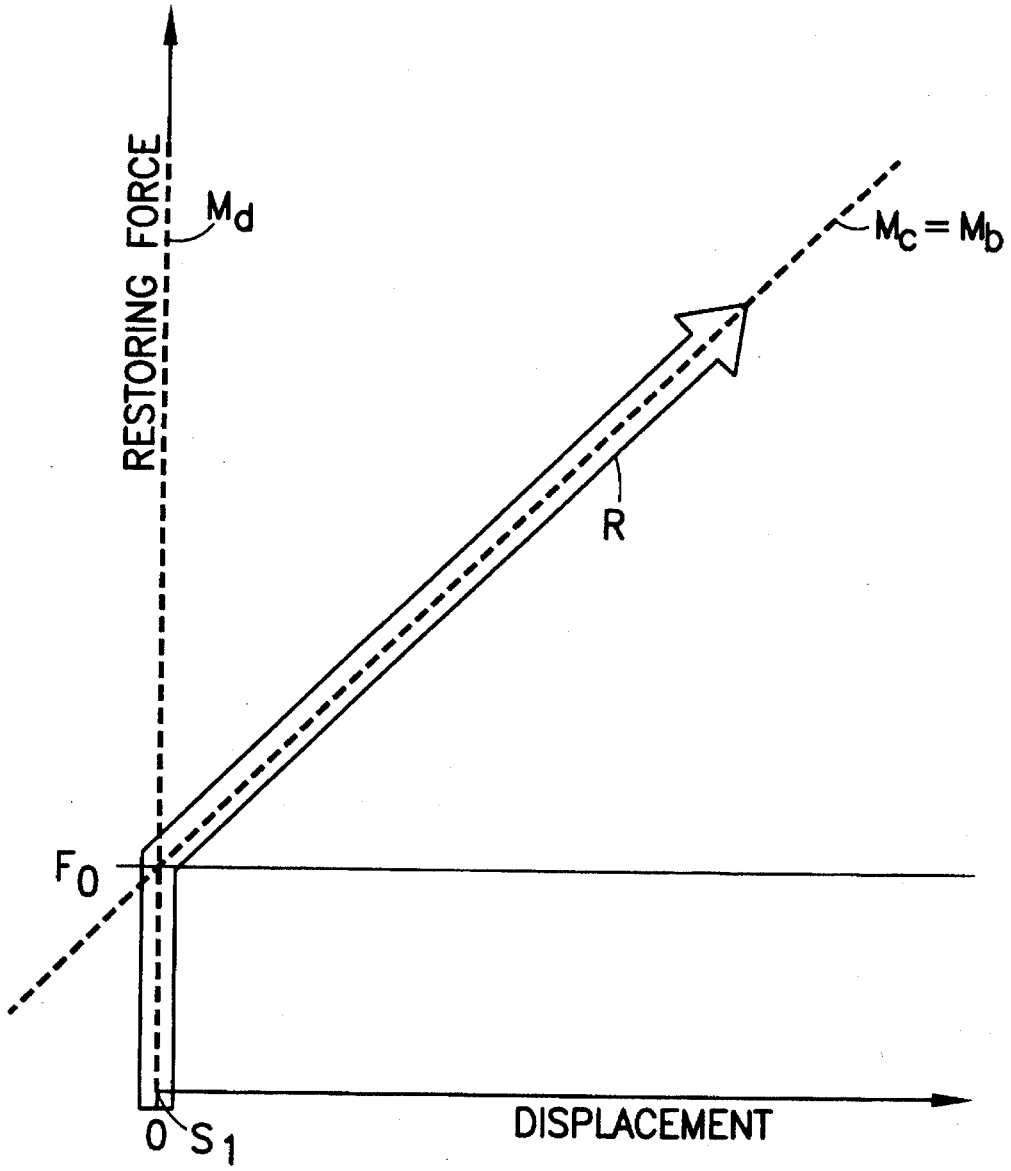
FIG. 3*c* is a restoring force-displacement curve characteristic of spring elements of the embodiment of FIGS. 1*a* and 1*b*, where a small-diameter spring element with a nearly infinite spring constant is employed.
Figure 4:
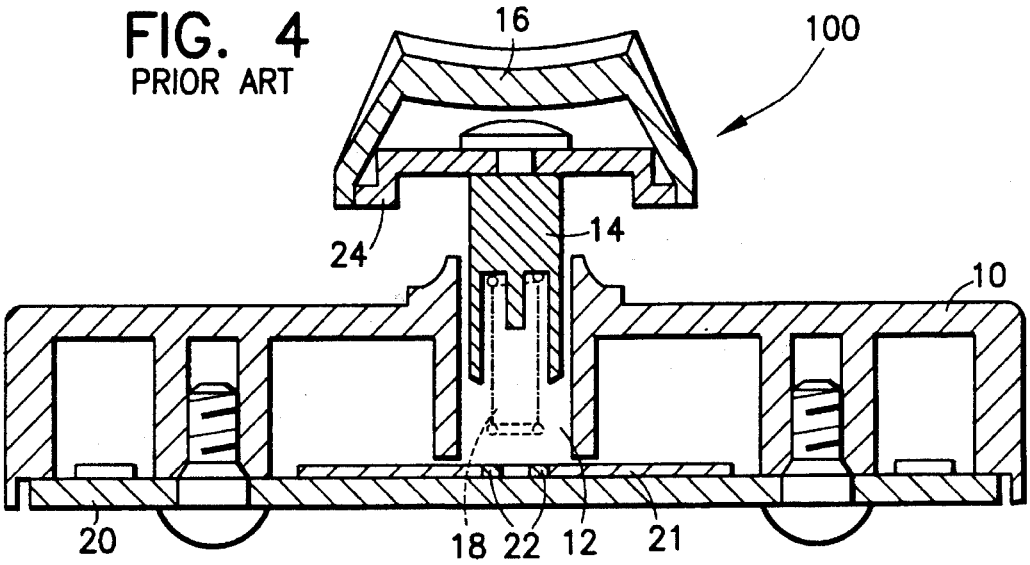
FIG. 4 PRIOR ART
FIG. 4 is a front cross section of an embodiment of a key switch according to the prior art.
Figure 5:
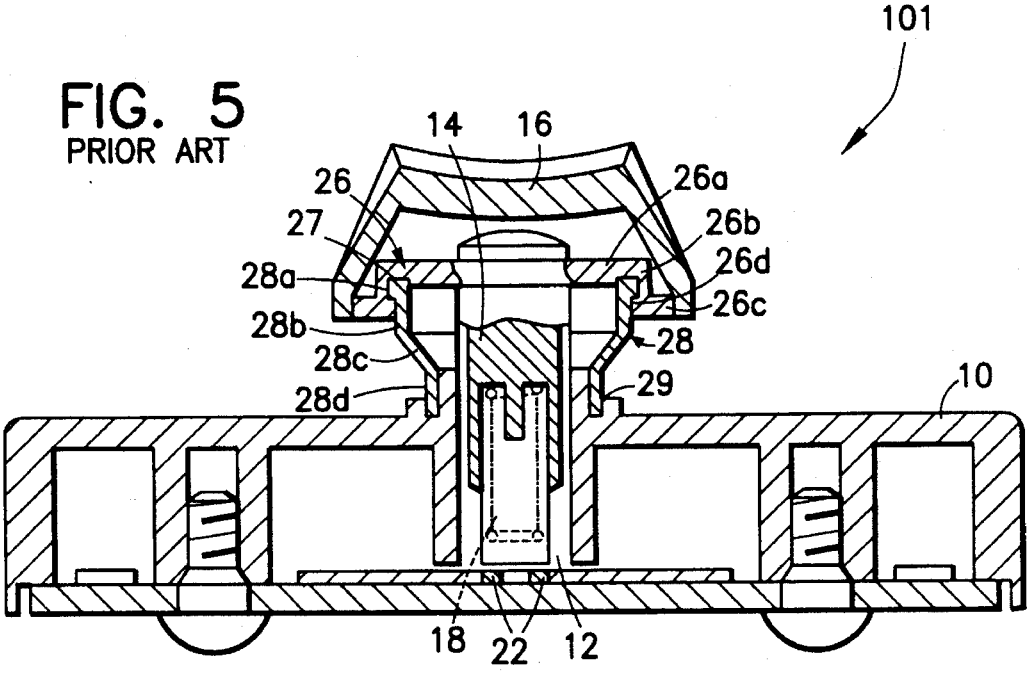
FIG. 5 PRIOR ART
FIG. 5 is a side cross section of a key switch according to the prior art.

Referring to FIG. 3*c*, the force displacement curve of a spring system where the spring constant of small-diameter coil spring 84 is virtually infinite is shown. If coil spring 84 is wound so that each winding of the coil rests on the adjacent windings so that it cannot be compressed further, it will have such a near-infinite spring constant. In this case, the spring constant of the combined system $M_c$ is the same as the spring constant of large-diameter coil spring 86. Here, the resultant curve R rises to the force level $F_0$ nearly instantly as the spring is displaced downwardly past the point where small-diameter coil spring 84 touches down on membrane switch 91.

Thus, the restoring force-displacement curve characteristic of small-diameter coil spring 84 governs from point 0 to point $S_1$. The restoring force-displacement curve characteristic of a two-spring combination governs from point $S_1$ and beyond. This resultant is represented by curve R. Curve R represents $M_d$ alone from point 0 to point $S_1$, and a superposition of curves $M_d$ and $M_b$ from beyond point $S_1$. Thus, curve R represents the force-displacement curve of the two spring-combination, from the point at which the free end of small-diameter coil spring 84 touches membrane switch 91. Note that FIG. 3*b* represents only the characteristics of the coil springs without the restoring force of boot 46.

Referring again to FIG. 3*a*, the curves of FIG. 3*b* are superimposed at the bottom-right of FIG. 3*a* for reference. When the stroke displacement reaches $S_b$, the free end of small-diameter coil spring 84 makes contact with FPC 96. Beyond point $S_b$ small-diameter coil spring 84 is compressed until point $S_1$ is reached. At point $S_1$, the restoring force of small-diameter coil spring 46 reaches the pre-compression force applied to large-diameter coil spring 86 by spring retaining ledges 80, 80. After point $S_1$, both springs are compressed simultaneously. The force-displacement curve $K_b$ after point $S_1$ is a superposition of the force-displacement curve of boot 62 and the combination spring system represented by $M_c$.

The force $F_0$ under which large-diameter coil spring 86 is retained can be set equal to a minimum force $F_a$ required to actuate, membrane switch 91. When the retaining force is so set, the force applied to membrane switch 91 increases rapidly with stroke displacement after point $S_b$ until membrane switch 91 is actuated at point $S_1$. Note that the initial retaining force $F_0$ need not be equal to the minimum force required to actuate membrane switch 91. As apparent in FIG. 3*a*, the point Qb, at which membrane switch 91 is actuated is closer to the force-minimum point B than the corresponding point $Q_a$ in the conventional switch as shown in FIG. 6.

Figure 6:
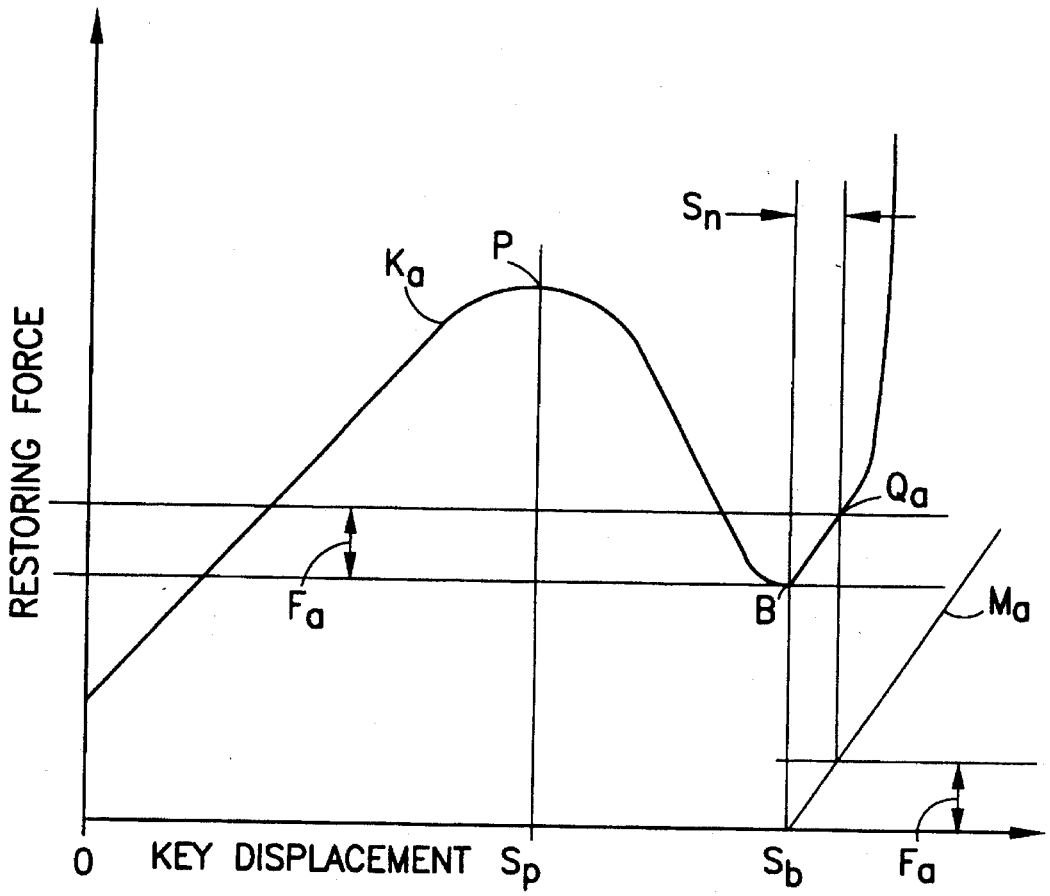
FIG. 6 PRIOR ART
FIG. 6 is a restoring force-displacement curve characteristic of the embodiment of FIG. 5.

Comparing FIGS. 3*a* and 6, note also that the restoring force of the multi-spring system indicated by $M_c$ is much smaller beyond point $Q_b$ than before it. This insures that key travel is not abruptly limited after small-diameter coil spring 84 touches down on FPC 96, as it would be if coil spring 18 of prior art key switch 101 were simply replaced by a stiffer spring. The force applied to membrane switch 91 rapidly builds to the minimum actuation force and thereafter rises less drastically. This permits a longer effective key travel, which is a desirable characteristic provided in the present invention.

Also note that the area under the force-displacement curves represents kinematic work performed. A system characterized by a rapidly rising force-displacement curve inherently drains less energy in rising to a given level of force than one in which the force-displacement curve rises slowly. When an operator strokes a key, an initial impulse is given to the operator's finger and key cap 46. Less of the kinetic energy, developed in the finger-key combination when the key is stroked, is drained prior to reaching the actuation-force point of membrane switch 91. This increases the likelihood that the force applied by small-diameter coil spring 84 will rise to a given level and thereby the likelihood that membrane switch 91 will be actuated.

Note that according to the above-described embodiment, to facilitate the type of spring retaining mechanism employed, the unrestrained spring is a small-diameter coil spring 84 and the restrained spring is a large-diameter coil spring 86. The invention, however, is not limited to this embodiment. Alternatively, the relative sizes of the restrained and unrestrained springs may be interchanged, or they could have the same diameter. When the same coil diameter is used, different spring constants can be obtained in the two springs by using different length springs or different wire diameters in the two springs.

Also note that, although in the above-described embodiment key stem 35 and key cap support 55 are integral elements, the invention is applicable to a design where the these elements are separately made and later connected.

The spring retaining mechanism consists of a lower cavity 44 in key stem 35 and inwardly projecting spring retaining ledges 80, 80 which are integral with the lower end of hollow cylinder 72 of stopper 70. The invention, however, is not limited to such an embodiment. For example, it can be applied to any structure wherein a second coil spring is kept compressed until the free end of a first coil spring is compressed sufficiently to overcome the pre-compression of the second spring after touching a membrane switch.

In another embodiment of the present invention, a sliding member and a key cap support are separately fabricated or the key cap support is eliminated. In this case the sliding member can be in the form of a hollow cylinder with its lower end being integral with inwardly projecting ledges. A shaft-like portion of a key cap could be press-fitted from above into the hollow of the sliding member, so that the lower end of the shaft-like portion and the ledges would provide a coil spring retaining mechanism.

In the embodiment of FIG. 1 the present invention is applied to a key switch having a membrane switch consisting of an FPC with stationary contacts, a spacer and an FPC with a movable contact, laminated on a PWB. The present invention can also be applied to a key switch where membrane switch 91 consists of a lower FPC with stationary contacts on its upper surface, a spacer and an upper FPC with a movable contact on its lower surface, laminated on a reinforcement plate.

Furthermore in the embodiment of FIG. 1, the present invention is applied to a key switch in which a boot is used to force a key cap to its initial home position. This invention, however, can be applied also to a key switch employing an independent coil spring, other than that used to urge membrane switch 91, to return the key cap back to its home position.

According to the embodiment of FIG. 1, a key switch has a coil spring consisting of integral first and second coil springs. A spring retaining mechanism retains the second coil spring under a compressed condition at a pre-set initial force until the first spring makes contact with a membrane switch. Then, the first spring is compressed until the force it applies to the second spring overcomes the retaining force of the second spring. Consequently, the displacement between the switch turn-on point and the force-minimum point on the force-displacement curve, characteristic of the key switch system, can be minimized. Thus, even if the downward stroke displacement beyond the force-minimum is small, as would occasion operation by a professional operator, the switch can be reliably actuated. This is an improvement in the operability of the key board switch.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A key switch, comprising:

a housing;

a key element;

a switch connected to said housing;

a first spring operatively associated with said key element;

means, connected to said key element, for applying a retaining force to said first spring such that said first spring is maintained in a partially strained state whereby a non-zero initial force must be applied to said first spring to strain it further;

a second spring operatively associated with said first spring;

said second spring having a free end;

means for displacing said free end toward said switch when said key element is displaced and for pressing said free end against said switch when said key element is displaced further whereby said switch is actuated;

said second spring being strained by a force of said pressing;

said first spring being strained beyond said partially strained state only when said force of said pressing exceeds said non-zero initial force;

said non-zero initial force being transmitted through said second spring to said first spring to cause said non-zero initial force to strain said first spring beyond said partially strained state.

2. Apparatus as in claim 1, wherein:

said first and second springs include first and second restoring force-displacement functions, respectively;

each of said first and second restoring force-displacement functions is substantially linear; and said first restoring force-displacement function has a first slope equal to a first spring constant of said first spring; and said second restoring force-displacement function has a second slope equal to a second spring constant of said second spring.

3. Apparatus as in claim 2, wherein said second slope is greater than said first slope.

4. Apparatus as in claim 2, wherein:

said force of said pressing is proportional to a combined restoring force of said first and second springs;

said combined restoring force is governed by a third restoring force-displacement function;

a first portion of said third restoring force-displacement function being substantially linear with a third slope equal to said first spring constant; and a second portion of said third restoring force-displacement function being substantially linear with a fourth slope equal to a product of said first and second spring constants divided by a sum of said first and second spring constants.

5. Apparatus as in claim 1, wherein:

said first and second springs are coil springs, each having an axis;

said first and second springs are substantially coaxial; and an end of said first spring is attached to an end of said second spring.

6. Apparatus as in claim 1, wherein said switch is a membrane switch comprising:

a flexible printed circuit;

a movable contact attached to said flexible printed circuit;

a printed wiring board;

a stationary contact attached to said printed wiring board;

a spacer, connected to said flexible printed circuit and said printed wiring board; and said spacer maintaining a first distance between said printed wiring board and said flexible printed circuit whereby a second distance is maintained between said movable and stationary contacts.

7. Apparatus as in claim 1, wherein said means for applying a retaining force includes:

a stopper connected to said key element;

said stopper having a recess for receiving said first spring within said recess; and inwardly projecting ledges attached to said stopper at an opening of said recess which compress said spring between said inwardly projecting ledges and a blind end of said recess.

8. Apparatus as in claim 1, further comprising:

a flexible boot of resilient material surrounding a part of said key switch;

said flexible boot being attached at an end thereof to said key element;

said flexible boot being attached at a further end thereof to said housing whereby said boot deforms when said key element is depressed.

9. Apparatus as in claim 8, wherein:

a displacement of said key element causes a buckling of said flexible boot when said flexible boot is deformed;

said buckling of said flexible boot imparts a non-linear restoring force to said key element as said key element is displaced relative to said housing;

said restoring force is a function of said displacement;

said function has a peak; and said pressing of said switch occurs at a point in said displacement after said peak of said restoring force function.

10. A key switch, comprising:

a housing;

a key stem guide sleeve integral with said housing;

a key stem slidably inserted in said key stem guide sleeve;

a first spring connected to said key stem;

a retainer for applying a retaining force to said first spring such that said first spring is maintained in a partially strained state, whereby a non-zero initial force must be applied to said first spring to strain it further;

a second spring, having a free end;

a further end of said second spring being connected to an end of said first spring;

said free end being displaced toward a switch upon a displacement of said key stem in a positive direction; and said free end making contact with and applying a force to said switch upon a further displacement of said key stem in said positive direction, whereby said switch is actuated;

said second spring being strained by said force thereby producing a restoring force which restoring force said second spring transmits to said first spring; and said first spring being further strained beyond said partially strained state when said restoring force exceeds said non-zero initial force.

11. Apparatus as in claim 10, wherein said retainer includes:

a stopper connected to said key stem;

said stopper having a recess for receiving said first spring within said recess;

said recess having a blind end;

inwardly projecting ledges attached to said stopper at an opening of said recess; and said inwardly projecting ledges compressing said first spring between said inwardly projecting ledges and said blind end of said recess.

12. Apparatus as in claim 10, wherein:

said first and second springs are coil springs, each having an axis; and said first spring and said second spring are coaxially connected to each other.

13. Apparatus as in claim 11, wherein:

said key stem includes a hollow;

said stopper is insertable in said hollow;

said stopper includes means for engaging said key stem upon inserting said stopper in said hollow; and said first spring being compressed when said stopper is inserted into said hollow.

14. A key switch, comprising:

a housing;

a switch;

a key, movably mounted to said housing, for actuating said switch;

an actuating member having a free end;

a resilient member;

means for transferring a force applied to said key through said resilient member to said actuating member and said free end;

said free end touching said switch at a point in a displacement of said key;

said free end applying a further force to said switch when said key is displaced in a positive direction beyond said point;

said further force straining said resilient member;

said further force being a function of said displacement;

said function having a first generally linear region with a slope substantially higher than a slope of a second generally linear region of said function;

said first generally linear region beginning at said point and extending in said positive direction relative to said point; and said second generally linear region beginning at an end of said first generally linear region and extending in said positive direction beyond said end.

15. Apparatus as in claim 14 wherein:

said resilient member includes a pair of springs;

one of said pair is retained in a partially strained state such that an initial force must be applied to said one to strain it further;

the other of said pair is operatively associated with said one;

said actuating member being a portion of said other; and said other being connected to transmit said further force to said one.

16. Apparatus as in claim 14, wherein said switch is a membrane switch comprising:

a flexible printed circuit;

a movable contact attached to said flexible printed circuit;

a printed wiring board;

a stationary contact attached to said printed wiring board;

a spacer, connected to said flexible printed circuit and said printed wiring board; and said spacer maintaining a fixed distance between said printed wiring board and said flexible printed circuit whereby a further fixed distance is maintained between said movable and stationary contacts.

17. A key switch, comprising:

a housing;

a switch attached to said housing;

a key, movably mounted to said housing;

means for applying an actuating force to said switch;

said means for applying including a resilient member retained under an initial amount of strain;

said actuating force resulting from a pressing force applied to said key;

said pressing force being transmitted by said means for applying, through said resilient member, to generate said actuating force;

said means for applying including means for straining said resilient member beyond said initial amount when said pressing force exceeds a specified value; and said specified value being a function of said initial amount of strain.

18. Apparatus as in claim 17, wherein said switch is a membrane switch comprising:

a flexible printed circuit;

a movable contact attached to said flexible printed circuit;

a printed wiring board;

a stationary contact attached to said printed wiring board;

a spacer, connected to said flexible printed circuit and said printed wiring board; and said spacer maintaining a fixed distance between said printed wiring board and said flexible printed circuit whereby a further fixed distance is maintained between said movable and stationary contacts.

* * * * *